US010464327B2

(12) United States Patent
Takahashi

(10) Patent No.: US 10,464,327 B2
(45) Date of Patent: Nov. 5, 2019

(54) INKJET RECORDING DEVICE AND METHOD FOR MAINTAINING SAME

(71) Applicant: FUJIFILM Corporation, Tokyo (JP)

(72) Inventor: Shuji Takahashi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 1744 days.

(21) Appl. No.: 14/092,657

(22) Filed: Nov. 27, 2013

(65) Prior Publication Data

US 2014/0085377 A1 Mar. 27, 2014

Related U.S. Application Data

(63) Continuation of application No. PCT/JP2012/064053, filed on May 31, 2012.

(30) Foreign Application Priority Data

May 31, 2011 (JP) ..... 2011-122295

(51) Int. Cl.
*B41J 2/165* (2006.01)
*B41J 2/16* (2006.01)
*B41J 2/14* (2006.01)

(52) U.S. Cl.
CPC ..... *B41J 2/16535* (2013.01); *B41J 2/1433* (2013.01); *B41J 2/1606* (2013.01); (Continued)

(58) Field of Classification Search
CPC ..... B41J 2/165; B41J 2002/165; B41J 29/38; B41J 29/393
See application file for complete search history.

(56) References Cited

U.S. PATENT DOCUMENTS 5,365,255 A * 11/1994 Inoue ..... B41J 2/14016 347/45
6,341,836 B1 * 1/2002 Koike ..... B41J 2/1606 347/20

FOREIGN PATENT DOCUMENTS

JP 8-187876 A 7/1996
JP 8-281962 A 10/1996
(Continued)

OTHER PUBLICATIONS

International Search Report issued in PCT/JP2012/064053, dated Jul. 24, 2012.

*Primary Examiner* — Scott A Richmond
(74) *Attorney, Agent, or Firm* — Birch, Stewart, Kolasch & Birch, LLP

(57) ABSTRACT

There are provided an inkjet recording device that can stably secure liquid-repellent performance on a surface of a liquid-repellent film formed on a nozzle surface for a long term, and a maintenance method thereof. The inkjet recording device includes: an inkjet head that has a nozzle surface in which a nozzle opening of a nozzle to eject a liquid is formed and on which a liquid-repellent film is formed with an amorphous fluorine resin material; a cleaning portion that wipes off and cleans a surface of the liquid-repellent film by a wiping member; and a liquid-repellent performance recovery processing portion that performs liquid-repellent performance recovery processing to recover liquid-repellent performance on the surface of the liquid-repellent film by heating the liquid-repellent film.

12 Claims, 12 Drawing Sheets

(52) U.S. Cl.
CPC .. *B41J 2/16585* (2013.01); *B41J 2002/16564* (2013.01); *B41J 2002/16573* (2013.01)

(56) References Cited

FOREIGN PATENT DOCUMENTS

| | | | |
|---|---|---|---|
| JP | 2004-155154 | A | 6/2004 |
| JP | 2008-183853 | A | 8/2008 |
| JP | 2010-5994 | A | 1/2010 |
| JP | 2010-197821 | A | 9/2010 |

* cited by examiner

INKJET RECORDING DEVICE AND METHOD FOR MAINTAINING SAME

BACKGROUND OF THE INVENTION

Field of the Invention

The presently disclosed subject matter relates to an inkjet recording device and a maintenance method thereof. Specifically, the presently disclosed subject matter relates to an inkjet recording device in which a liquid-repellent film is formed on a nozzle surface of an inkjet head and a maintenance method thereof.

Description of the Related Art

When dirt such as ink and paper powder adheres near a nozzle opening in a nozzle surface of an inkjet head, it becomes likely to cause defective ejection such as bending of the ejection direction of an ink drop from the nozzle opening. Therefore, the nozzle surface of the inkjet head is subjected to liquid-repellent treatment so as to prevent dirt from adhering near the nozzle opening.

However, even in a case where the nozzle surface is subjected to the liquid-repellent treatment, it is not possible to completely prevent dirt from adhering to the nozzle surface. Therefore, a cleaning of the nozzle surface is periodically performed.

The cleaning of the nozzle surface is generally performed by wiping off the nozzle surface by a blade (wiper) or a wiping cloth. However, when the cleaning is repeatedly performed, there is a problem that the liquid-repellent film formed on the nozzle surface gradually comes off and the liquid-repellent performance degrades. As an example, in an inkjet head in the related art, a contact angle of ink with respect to a nozzle surface is measured after the cleaning of the nozzle surface is performed 1000 times, and the measured contact angle decreases by about 20% as compared with a contact angle of ink with respect to the nozzle surface before the cleaning. In a case where the contact angle of ink with respect to the nozzle surface decreases by 20%, it is difficult to hold meniscus of ink in the nozzle. There occur problems that the ejection direction of an ink drop from a nozzle opening bends or ejection is completely impossible, and so on.

To solve the above-mentioned problems, Japanese Patent Application Laid-Open No. 08-187876 and Japanese Patent Application Laid-Open No. 08-281962 suggest a technique of applying a liquid-repellent agent to a nozzle surface to and recoat the nozzle surface every time the nozzle surface is wiped off and cleaned.

Japanese Patent Application Laid-Open No. 2008-183853 suggests a technique of reducing a pressing pressure of a wiper member with respect to a nozzle surface and preventing a liquid-repellent film on the nozzle surface from being worn out by forming the wiper member that wipes off the nozzle surface with a plurality of wiper parts.

SUMMARY OF THE INVENTION

In the techniques suggested in Japanese Patent Application Laid-Open No. 08-187876 and Japanese Patent Application Laid-Open No. 08-281962, since the liquid-repellent agent is simply applied onto the nozzle surface, the liquid-repellent film formed on the nozzle surface easily comes off. Therefore, it is difficult to secure the stable liquid-repellent performance, and it is difficult to uniformly apply the liquid-repellent agent onto the nozzle surface.

In the technique suggested in Japanese Patent Application Laid-Open No. 2008-183853, although it is possible to reduce the wear-out of the liquid-repellent film on the nozzle surface due to wiping by the wiper member, it is not possible to completely suppress the wear-out, and, as a result, the liquid-repellent performance degrades over time.

The presently disclosed subject matter is made in view of such conditions and it is an object to provide an inkjet recording device that can stably secure liquid-repellent performance on a surface of a liquid-repellent film formed on a nozzle surface for a long term, and a maintenance method thereof.

To achieve the above-mentioned object, an inkjet recording device according to an aspect of the presently disclosed subject matter includes: an inkjet head that has a nozzle surface in which a nozzle opening of a nozzle to eject a liquid is formed and on which a liquid-repellent film is formed with an amorphous fluorine resin material; a cleaning portion configured to wipe off and clean a surface of the liquid-repellent film by a wiping member; and a liquid-repellent performance recovery processing portion configured to perform liquid-repellent performance recovery processing to recover liquid-repellent performance on the surface of the liquid-repellent film by heating the liquid-repellent film.

According to this aspect, the liquid-repellent film is formed with the amorphous fluorine resin material on the nozzle surface of the inkjet head. By applying heat treatment to this liquid-repellent film, it is possible to recover the liquid-repellent performance on the surface. The reason is that the fluorine substrate in the liquid-repellent film moves to the surface of the liquid-repellent film by heating and the liquid-repellent performance on the surface of the liquid-repellent film recovers (the fluorine substrate is subjected to the driving force by heating and moves to the surface of the liquid-repellent film). Therefore, in a case where the liquid-repellent performance on the surface of the liquid-repellent film degrades by repeating the cleaning, the liquid-repellent film is heated by the liquid-repellent performance recovery processing portion to recover the liquid-repellent performance on the surface of the liquid-repellent film. As a result of this, it is possible to stably secure excellent liquid-repellent performance for a long term.

Preferably, the inkjet recording device further includes a contact angle measurement portion configured to measure a contact angle of the liquid with respect to the surface of the liquid-repellent film, in which the liquid-repellent performance recovery processing portion performs the liquid-repellent performance recovery processing only in a case where the contact angle measured by the contact angle measurement portion is equal to or less than a recovery processing execution angle threshold defined in advance.

According to this aspect, the contact angle measurement portion measures the contact angle of the liquid with respect to the surface of the liquid-repellent film before the liquid-repellent performance recovery processing portion performs the liquid-repellent performance recovery processing. Subsequently, the liquid-repellent performance recovery processing portion performs the liquid-repellent performance recovery processing only in a case where the measured contact angle is equal to or less than the recovery processing execution angle threshold (a reference contact angle to perform recovery processing) defined in advance. As a result of this, it is possible to perform the liquid-repellent performance recovery processing at an appropriate timing.

Preferably, the inkjet recording device further includes a cleaning number count portion configured to count a number of times the cleaning portion cleans the surface of the liquid-repellent film, in which the contact angle measurement portion measures the contact angle only in a case where the number of times of cleaning counted by the cleaning number count portion reaches a contact angle measurement execution number threshold defined in advance.

According to this aspect, when the number of times the cleaning portion performs cleaning reaches the contact angle measurement execution number threshold (a reference cleaning number to implement the measurement of the contact angle) defined in advance, the contact angle measurement portion measures the contact angle. As a result of this, it is possible to periodically check the liquid-repellent performance on the surface of the liquid-repellent film and perform the liquid-repellent performance recovery processing more appropriately. The contact angle measurement execution number threshold is, for example, 100 times, and the contact angle of the liquid with respect to the surface of the liquid-repellent film is measured every time the cleaning is performed 100 times.

Preferably, the recovery processing execution angle threshold is 60 degrees.

According to this aspect, it is possible to appropriately perform the liquid-repellent performance recovery processing before the liquid-repellent performance on the surface of the liquid-repellent film is lost.

Preferably, the inkjet recording device further includes a cleaning number count portion configured to count a number of times the cleaning portion cleans the surface of the liquid-repellent film, in which the liquid-repellent performance recovery processing portion performs the liquid-repellent performance recovery processing only in a case where the number of times of cleaning counted by the cleaning number count portion reaches a recovery processing execution number threshold defined in advance.

According to this aspect, when the number of times the cleaning portion implements the cleaning reaches the recovery processing execution number threshold (a reference cleaning number to perform the liquid-repellent performance recovery processing) defined in advance, the liquid-repellent performance recovery processing is forcibly performed. As a result of this, it is possible to periodically perform the liquid-repellent performance recovery processing and stably secure excellent liquid-repellent performance for a long term. The recovery processing execution number threshold is, for example, 500 times, and the liquid-repellent performance recovery processing is forcibly performed every time the cleaning is performed 500 times.

Preferably, the liquid-repellent performance recovery processing portion heats a whole surface of the liquid-repellent film in the liquid-repellent performance recovery processing at a time.

According to this aspect, it is possible to uniformly heat the whole surface of the liquid-repellent film and recover the liquid-repellent performance on the surface of the liquid-repellent film without non-uniformity.

Preferably, the liquid-repellent performance recovery processing portion heats the liquid-repellent film at a temperature between 90 degrees Celsius and a melting point of the amorphous fluorine resin material, inclusive, for a certain period of time, in the liquid-repellent performance recovery processing.

In a case where the amorphous fluorine resin is used as a material of the liquid-repellent film, there is a problem that, if the liquid-repellent film is excessively heated, the amorphous fluorine resin softens and the pattern formed in the liquid-repellent film collapses. Especially, when it is heated over the melting point of the amorphous fluorine resin, the liquid-repellent film melts and enters in the nozzle, or an ejection slot of the nozzle is transformed into a taper shape. Thus, an ejection defect is caused. By heating the liquid-repellent film at a temperature between 90 degrees Celsius and the melting point of the amorphous fluorine resin material, inclusive, for the certain period of time, it is possible to solve these problems and efficiently recover the liquid-repellent performance on the surface of the liquid-repellent film.

Preferably, the liquid-repellent performance recovery processing portion heats the liquid-repellent film at about 100 degrees Celsius for the certain period of time in the liquid-repellent performance recovery processing.

According to this aspect, it is possible to efficiently recover the liquid-repellent performance on a surface of the liquid-repellent film without causing problems that the pattern formed in the liquid-repellent film is transformed, the liquid-repellent film melts and enters in the nozzle and the ejection slot of the nozzle is transformed into a taper shape. The heating time is, for example, about one minute.

Preferably, the inkjet recording device further includes: a cleaning number count portion configured to count a number of times the cleaning portion cleans the surface of the liquid-repellent film; and a contact angle measurement portion configured to measure a contact angle of the liquid with respect to the surface of the liquid-repellent film, in which: the contact angle measurement portion measures the contact angle only in a case where the number of times of cleaning counted by the cleaning number count portion reaches a contact angle measurement execution number threshold defined in advance; the liquid-repellent performance recovery processing portion performs the liquid-repellent performance recovery processing only in a case where the contact angle measured by the contact angle measurement portion is equal to or less than a recovery processing execution angle threshold defined in advance; and the liquid-repellent performance recovery processing portion heats the liquid-repellent film at a temperature between 90 degrees Celsius and a melting point of the amorphous fluorine resin material, inclusive, for a certain period of time, in the liquid-repellent performance recovery processing.

Preferably, the recovery processing execution angle threshold is 60 degrees.

Moreover, to achieve the above-mentioned object, a maintenance method of the inkjet recording device according to an aspect of the presently disclosed subject matter is a maintenance method of an inkjet recording device that records an image on a recording medium using an inkjet head that has a nozzle surface in which a nozzle opening of a nozzle to eject a liquid is formed and on which a liquid-repellent film is formed with an amorphous fluorine resin material, and includes: a cleaning step of wiping off and cleaning a surface of the liquid-repellent film by a wiping member; and a liquid-repellent performance recovery processing step of recovering liquid-repellent performance on the surface of the liquid-repellent film by heating the liquid-repellent film.

Preferably, the maintenance method further includes a contact angle measurement step of measuring a contact angle of the liquid with respect to the surface of the liquid-repellent film, in which the liquid-repellent performance recovery processing is executed only in a case where the contact angle measured in the contact angle measurement step is equal to or less than a recovery processing execution angle threshold defined in advance.

Preferably, the maintenance method further includes a cleaning number count step of counting a number of times the cleaning step is executed, in which the contact angle measurement step is executed only in a case where the number of times of cleaning counted in the cleaning number count step reaches a contact angle measurement execution number threshold defined in advance.

Preferably, the recovery processing execution angle threshold is 60 degrees.

Preferably, the maintenance method further includes a cleaning number count step of counting a number of times the cleaning step is executed, in which the liquid-repellent performance recovery processing step is executed only in a case where the number of times of cleaning counted in the cleaning number count step reaches a recovery processing execution number threshold defined in advance.

Preferably, a whole surface of the liquid-repellent film is heated at a time in the liquid-repellent performance recovery processing step.

Preferably, the liquid-repellent film is heated at a temperature between 90 degrees Celsius and a melting point of the amorphous fluorine resin material, inclusive, for a certain period of time, in the liquid-repellent performance recovery processing step.

Preferably, the liquid-repellent film is heated at about 100 degrees Celsius for the certain period of time in the liquid-repellent performance recovery processing step.

Preferably, the maintenance method further includes: a cleaning number count step of counting a number of times the cleaning step is executed; and a contact angle measurement step of measuring a contact angle of the liquid with respect to the surface of the liquid-repellent film, in which: the contact angle measurement step is executed only in a case where the number of times of cleaning counted in the cleaning number count step reaches a contact angle measurement execution number threshold defined in advance; the liquid-repellent performance recovery processing step is executed only in a case where the contact angle measured in the contact angle measurement step is equal to or less than a recovery processing execution angle threshold defined in advance; and the liquid-repellent film is heated at a temperature between 90 degrees Celsius and a melting point of the amorphous fluorine resin material, inclusive, for a certain period of time, in the liquid-repellent performance recovery processing step.

Preferably, the recovery processing execution angle threshold is 60 degrees.

According to the presently disclosed subject matter, it is possible to stably secure the liquid-repellent performance on the surface of a liquid-repellent film formed on a nozzle surface for a long term.

DETAILED DESCRIPTION OF EXEMPLARY EMBODIMENTS

In the following, a preferable embodiment of the presently disclosed subject matter is explained in detail according to the accompanying drawings.

[Structure of Inkjet Recording Device]

FIGS. 1, 2, 3 and 4 are a front view, plan view, side view and block diagram illustrating structures of main components of an inkjet recording device according to the present embodiment, respectively.

Figure 1:
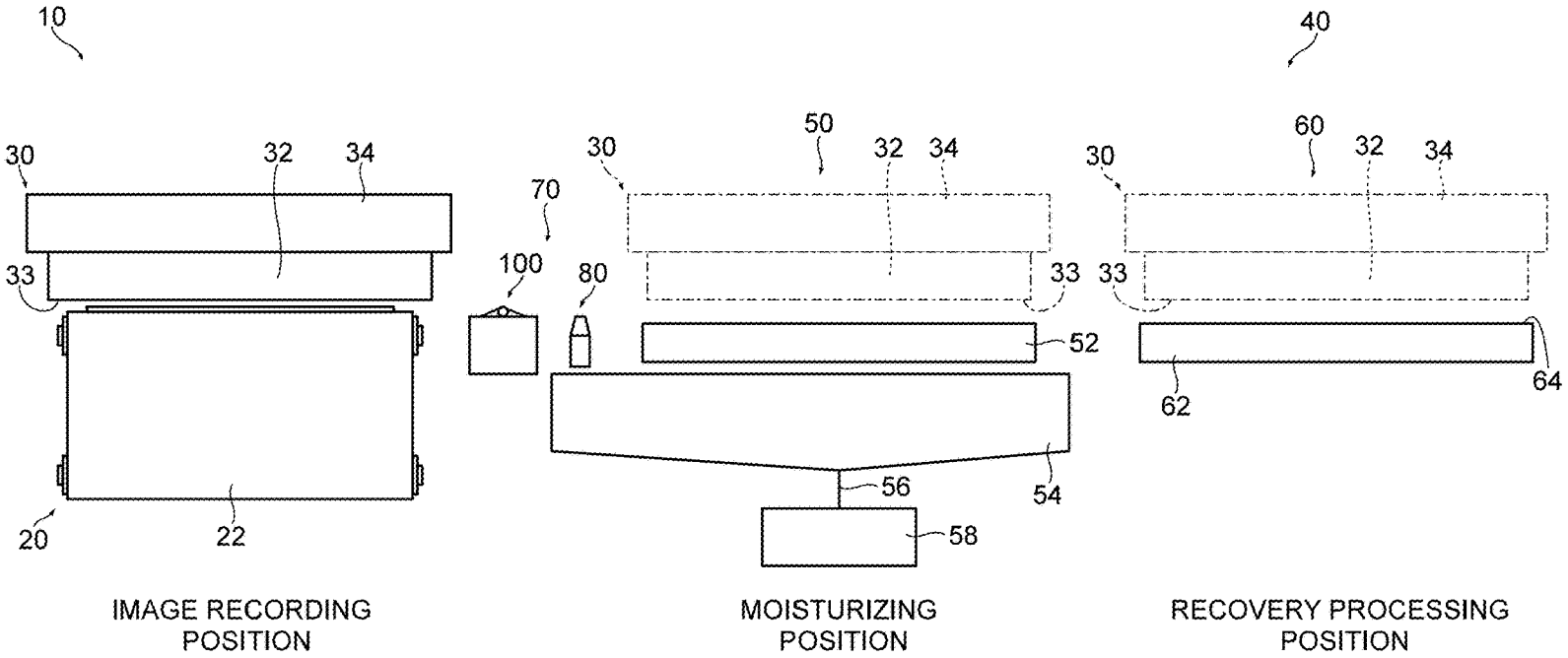
FIG. 1 is a front view illustrating structures of main components of an inkjet recording device.
Figure 2:
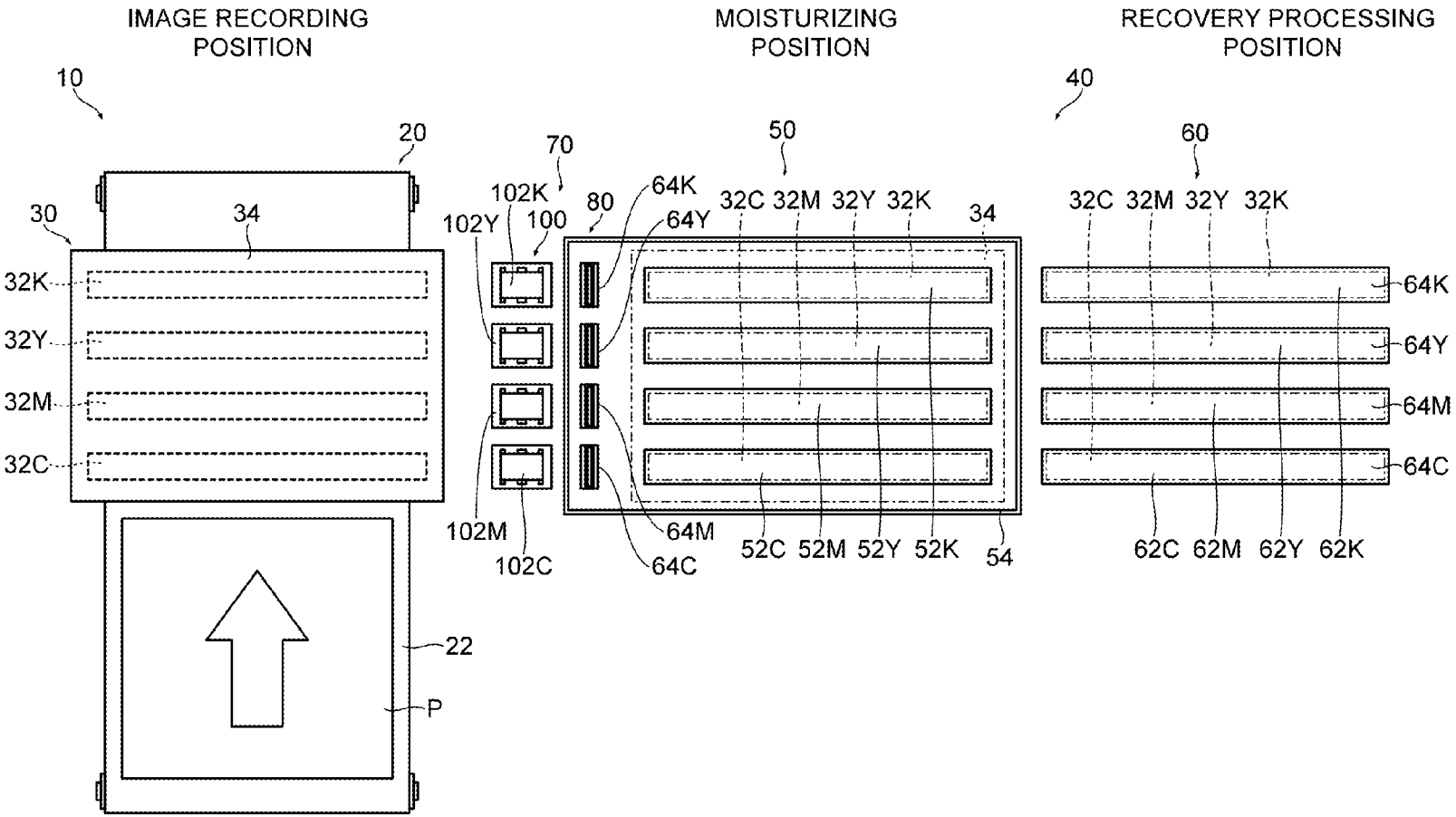
FIG. 2 is a plan view illustrating structures of main components of the inkjet recording device.
Figure 3:
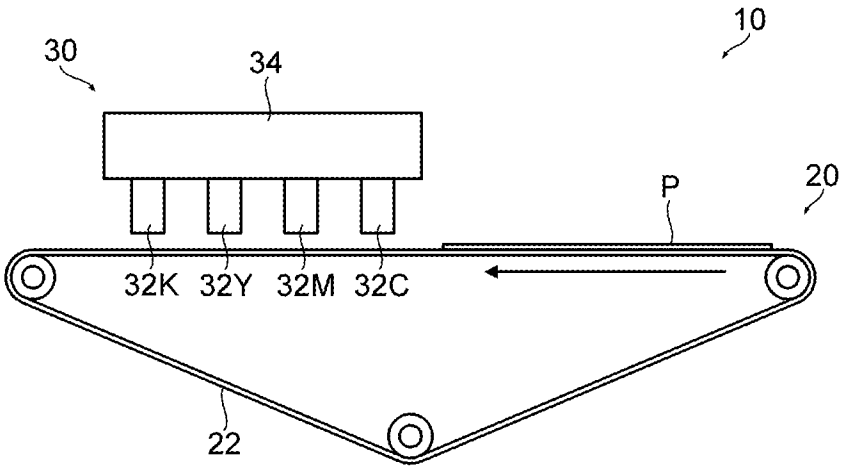
FIG. 3 is a side view illustrating a structure of main components of the inkjet recording device.
Figure 4:
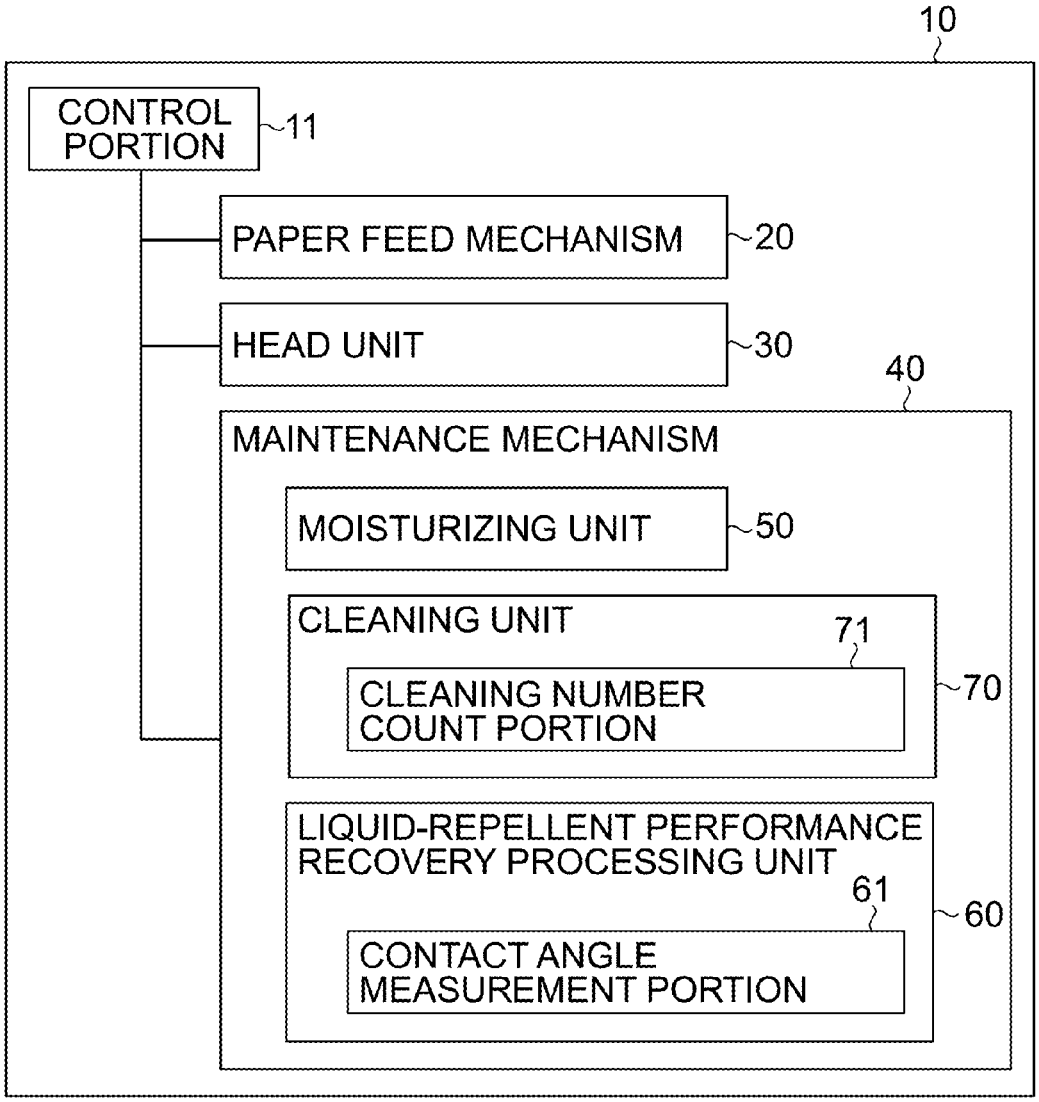
FIG. 4 is a block diagram illustrating a structure of main components of the inkjet recording device.

As illustrated in FIGS. 1, 2 and 3, this inkjet recording device 10 is a line printer of a single-pass scheme. The inkjet recording device 10 includes a control portion 11 that controls the whole of the inkjet recording device 10, a paper feed mechanism 20 that feeds paper (sheet) P, a head unit 30 that mounts inkjet heads (hereinafter simply referred to as "heads") 32C, 32M, 32Y and 32K to eject ink drops of cyan (C), magenta (M), yellow (Y) and black (K) and deposits the ink drops of multiple colors of C, M, Y and K onto the paper P fed by the paper feed mechanism 20, and a maintenance mechanism 40 that maintains the heads 32C, 32M, 32Y and 32K mounted on the head unit 30.

The paper feed mechanism 20 is formed with a belt feed mechanism, causes a running endless belt 22 to adhere to the paper P and horizontally feeds the paper P.

The head unit 30 includes the head 32C that ejects an ink drop of cyan, the head 32M that ejects an ink drop of magenta, the head 32Y that ejects an ink drop of yellow, the head 32K that ejects an ink drop of black, a head support frame 34 to which the heads 32C, 32M, 32Y and 32K are attached, and a head support frame movement mechanism (not illustrated) that moves the head support frame 34.

Each of the heads 32C, 32M, 32Y and 32K is formed with a line head corresponding to the greatest paper width of the paper P of a printing target. Since configurations of the heads 32C, 32M, 32Y and 32K are the same, in the following explanation, they are described as the head 32 as illustrated in FIGS. 1, 5 and 6, except when they are especially distinguished from each other.

Each head 32 is formed in a rectangular block shape and a nozzle surface 33 is formed in the bottom.

Figure 5:
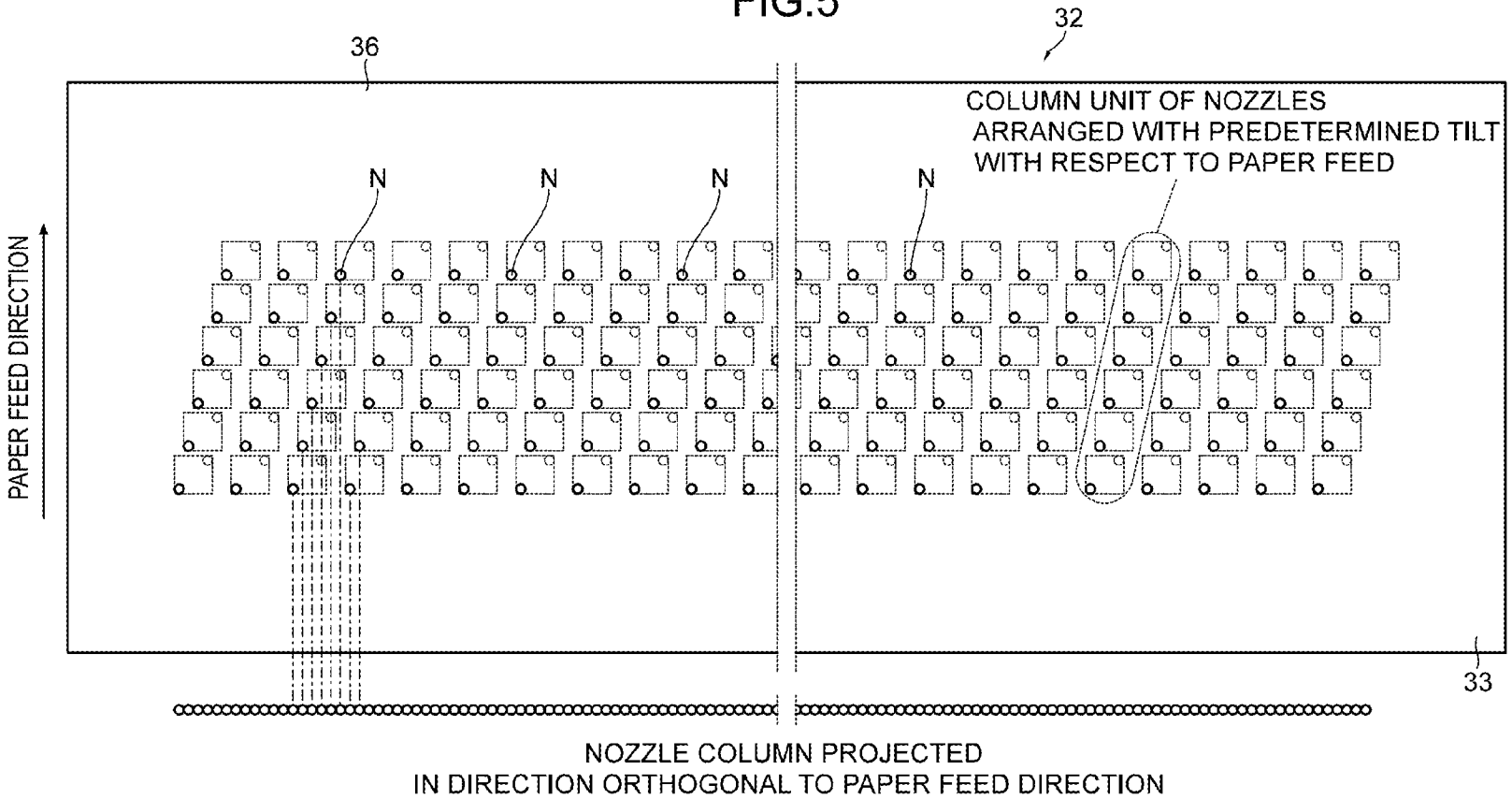
FIG. 5 is a plane perspective view of a nozzle surface of a head.
Figure 6:
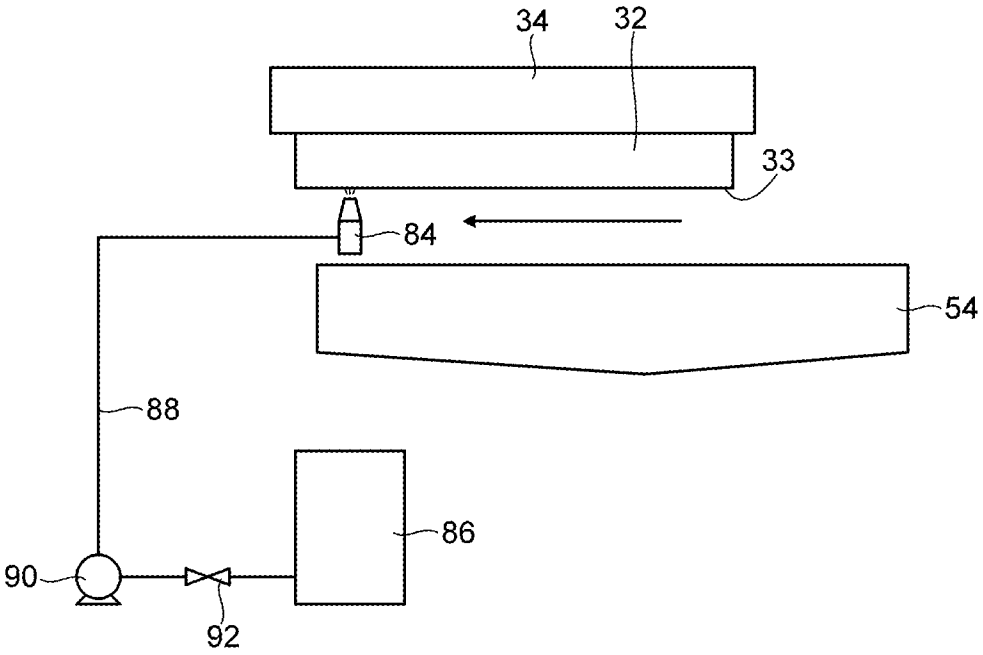
FIG. 6 is a front view illustrating a schematic structure of a cleaning solution applicator.

FIG. 5 is a plane perspective view of the nozzle surface 33 of the head 32.

The nozzle surface 33 is formed in a rectangle shape and a nozzle row is formed along a longitudinal direction thereof. The head 32 of the present embodiment is formed with a so-called matrix head, and a nozzle N is arranged in a two-dimensional matrix state on the nozzle surface 33. In the matrix head, it is possible to narrow the actual interval of nozzle N projected in the longitudinal direction of the head 32 and intend the density growth of nozzle N.

Moreover, the head 32 of the present embodiment ejects a droplet of ink from nozzle N in a so-called piezoelectric scheme. Each nozzle N is communicated with a pressure chamber and the droplet of ink is ejected from nozzle N by vibrating the wall surface of this pressure chamber by a piezoelectric actuator. The ink ejection scheme is not limited to this and may be a thermal scheme.

To prevent adhesion of dirt such as ink and paper powder, a liquid-repellent film 36 is formed in the nozzle surface 33 in which nozzle N is formed. This liquid-repellent film 36 is formed with an amorphous fluorine resin.

The liquid-repellent film 36 formed with an amorphous fluorine resin material can recover the liquid-repellent performance on the surface by heat treatment. The reason is that, when the liquid-repellent film 36 is heated, a fluorine substrate in the liquid-repellent film 36 acquires the driving force and moves to the surface of the liquid-repellent film 36, and thereby the concentration of the fluorine substrate in the surface of the liquid-repellent film 36 increases. Therefore, in a case where the liquid-repellent performance on the surface of the liquid-repellent film 36 degrades by repeating the cleaning of the nozzle surface 33 (to be more specific, the surface of the liquid-repellent film 36 formed on the nozzle surface 33), it is possible to recover the liquid-repellent performance on the surface of the liquid-repellent film 36 by heating the nozzle surface 33 (to be more specific, the liquid-repellent film 36 formed on the nozzle surface 33). This point is described later in detail.

For example, as an amorphous fluorine resin material, it is possible to use CYTOP (registered trademark) from Asahi Glass Co., Ltd. and Teflon AF (Teflon is a registered trademark) from Du Pont-Mitsui Fluorochemicals Company, Ltd.

The head support frame 34 includes a head attachment portion (not illustrated) to attach each head 32. Each head 32 is detachably attached to this head attachment portion.

Each head 32 attached to the head support frame 34 is arranged to be orthogonal to the feed direction of the paper P, and is arranged at predetermined intervals in a predetermined order along the feed direction of the paper P (in the present embodiment, they are arranged in order from cyan, magenta, yellow to black).

The head attachment portion is installed in the head support frame 34 so as to be able to rise and fall, driven by an up-and-down mechanism (not illustrated) and moved up and down. Each head 32 attached to the head attachment portion rises and falls in the vertical direction to the feed surface of the paper P by this up-and-down mechanism.

A head support frame movement mechanism (not illustrated) horizontally slides and moves the head support frame 34 in the direction orthogonal to the feed direction of the paper P. This head support frame movement mechanism includes, for example, a ceiling frame that is horizontally installed across the paper feed mechanism 20, a guide rail laid in the ceiling frame, a carrier that slides and moves on the guide rail and a drive mechanism (such as a feed screw mechanism, for example) that moves the carrier along the guide rail. The head support frame 34 is attached to the carrier and horizontally slides and moves.

When the head support frame 34 is driven by the head support frame movement mechanism and horizontally moves, each head 32 mounted on the head support frame 34 is installed so as to be movable among "image recording position," "moisturizing position" and "recovery processing position."

By moving to the "image recording position," each head 32 mounted on the head support frame 34 is arranged above the paper feed mechanism 20. As a result of this, it is possible to eject an ink drop from each head 32 to the paper P fed by the paper feed mechanism 20 and record an image in paper P fed by the paper feed mechanism 20.

The maintenance mechanism 40 includes a moisturizing unit 50 that performs moisturizing treatment of each head 32 mounted on the head support frame 34, a liquid-repellent performance recovery processing unit 60 that heats the nozzle surface 33 of each head 32 (to be more specific, the liquid-repellent film 36 formed on the nozzle surface 33) and performs liquid-repellent performance recovery processing on the surface of the liquid-repellent film 36, and a cleaning unit 70 that wipes off and cleans the nozzle surface 33 of each head 32 (to be more specific, the surface of the liquid-repellent film 36 formed on the nozzle surface 33).

The moisturizing unit 50 includes a cap 52 (52C, 52M, 52Y, 52K) that individually covers the nozzle surface 33 of the head 32 (32C, 32M, 32Y, 32K) mounted on the head support frame 34. By covering the nozzle surface 33 of each head 32 with this cap 52, the moisturizing unit 50 individually moisturizes the nozzle surface 33 of each head 32.

The moisturizing unit 50 is installed according to the head 32 located in the "moisturizing position." When the head 32 is located in the "moisturizing position," the cap 52 is arranged in a lower position of the head 32 (the cap 52 is arranged so as to face the nozzle surface 33 of the head 32). Each cap 52 is driven by the up-and-down mechanism, which is not illustrated in the figure, and moved up and down to contact to or separate from the nozzle surface 33 of each head 32.

Each cap 52 includes a pressurization and suction mechanism (not illustrated) to apply pressure and suction in the nozzle, and a cleaning solution supply mechanism (not illustrated) to supply cleaning solution into the cap 52. By performing pressurization and suction processing in nozzle N by the use of this cap 52 for each head 32, thickening of ink and extra air bubbles which stay in nozzle N can be removed. Moreover, by optionally storing the cleaning solution in the cap 52, it is possible to perform soak cleaning on the nozzle surface 33 by the cleaning solution.

A waste tray 54 is arranged in a lower position of the cap 52. The cleaning solution supplied to the cap 52 is discarded to this waste tray 54. The cleaning solution discarded to the waste tray 54 is collected by a waste tank 58 through a waste collection pipe 56 connected to the waste tray 54.

The moisturizing unit 50 is configured as above. The operation of the moisturizing unit 50 is controlled by the control portion 11 that controls the whole of the inkjet recording device 10. The control portion 11 executes a predetermined control program to control the drive of the up-and-down mechanism (not illustrated), pressurization and suction mechanism (not illustrated) and cleaning solution supply mechanism (not illustrated) or the like of the cap 52, and performs moisturizing treatment of the head 32 or the like.

The liquid-repellent performance recovery processing unit 60 includes a heater 62 (62C, 62M, 62Y, 62K) that individually heats the nozzle surface 33 of the head 32 (32C, 32M, 32Y, 32K) mounted on the head support frame 34. The liquid-repellent performance recovery processing unit 60 recovers the liquid-repellent performance on the surface of the liquid-repellent film 36 formed on the nozzle surface 33 of each head 32 by individually heating the nozzle surface 33 of each head 32 by this heater 62.

The heater 62 (62C, 62M, 62Y, 62K) has a smooth heating surface 64 (64C, 64M, 64Y, 64K) and heats the nozzle surface 33 by making this heating surface 64 contact to the nozzle surface 33. The heating surface 64 is formed according to the shape of the nozzle surface 33 so as to contact to the whole surface of the nozzle surface 33. Therefore, the heating surface 64 is formed in the same rectangle shape as the nozzle surface 33, and is formed in almost the same size as the nozzle surface 33 or formed in a slightly larger size than the nozzle surface 33. Such the heater 62 can be formed by covering a tabular rubber heater on an upper surface of a rectangular plate, for example.

The liquid-repellent performance recovery processing unit 60 is installed according to the head 32 located in the "recovery processing position." When the head 32 is located in the "recovery processing position," the heater 62 is arranged in a lower position of the head 32 (the nozzle surface 33 of the head 32 and the heating surface 64 of the heater 62 are arranged in an opposite manner).

Each heater 62 is attached to a body frame (not illustrated) of the liquid-repellent performance recovery processing unit 60 and installed in a predetermined position. The body frame of the liquid-repellent performance recovery processing unit 60 is driven by the up-and-down mechanism (not illustrated) and moved up and down, and thereby the heating surface 64 of each heater 62 contacts with or separates from the nozzle surface 33 of each head 32.

The liquid-repellent performance recovery processing unit 60 is configured as above. The operation of the liquid-repellent performance recovery processing unit 60 is controlled by the control portion 11 that controls the whole of the inkjet recording device 10. The control portion 11 executes a predetermined control program to control the drive of the heater 62 and up-and-down mechanism (not illustrated) of the heater 62 or the like, and performs liquid-repellent performance recovery processing on the head 32.

The cleaning unit 70 includes a cleaning solution applicator 80 that applies cleaning solution to the nozzle surface 33 of the head 32 and a wiping device 100 that wipes off the nozzle surface 33 to which the cleaning solution is applied. The cleaning unit 70 is arranged between the "moisturizing position" and the "image recording position," and cleans the head 32 mounted on the head support frame 34 during a time period in which the head 32 moves from the "moisturizing position" to the "image recording position."

FIG. 6 is a front view illustrating a schematic structure of the cleaning solution applicator 80.

As illustrated in FIG. 6, the cleaning solution applicator 80 includes a cleaning solution nozzle 84 that applies cleaning solution to the nozzle surface 33 of each head 32, a cleaning solution tank 86 in which the cleaning solution is stored, a cleaning solution pipe 88 that connects the cleaning solution tank 86 and each cleaning solution nozzle 84, a cleaning solution pump 90 that sends the cleaning solution from the cleaning solution tank 86 to each cleaning solution nozzle 84, and a cleaning solution valve 92 that opens and closes the cleaning solution pipe 88.

The cleaning solution nozzle 84 is installed for each of the heads 32C, 32M, 32Y and 32K, and is attached to a body frame (not illustrated) of a cleaning solution applicator according to the installation intervals of the heads 32C, 32M, 32Y and 32K. The body frame of the cleaning solution applicator is installed above the waste tray 54. As a result of this, it is possible to collect the cleaning solution jetted from the cleaning solution nozzle 84 by the waste tray 54.

The cleaning solution nozzle 84 has a nozzle with a width corresponding to the width of the nozzle surface 33 and ejects the cleaning solution from this nozzle. Each cleaning solution nozzle 84 is installed in the body frame of the cleaning solution applicator so as to upwardly jet the cleaning solution.

When each head 32 passes on this cleaning solution nozzle 84, the cleaning solution ejected from the nozzle hits the nozzle surface 33 and the cleaning solution is applied to the nozzle surface 33.

The cleaning solution nozzle 84 is connected to the cleaning solution tank 86 through the cleaning solution pipe 88. The cleaning solution pump 90 is installed in the middle of the cleaning solution pipe 88 and sends the cleaning solution stored in the cleaning solution tank 86 to each cleaning solution nozzle 84. The cleaning solution valve 92 is installed in the middle of the cleaning solution pipe 88 and opens and closes the pipe line of the cleaning solution pipe 88.

A configuration is possible in which the cleaning solution pump is individually installed for each cleaning solution nozzle, or a configuration is possible in which one cleaning solution pump is commonly used. The same applies to the cleaning solution valve.

The cleaning solution applicator 80 is configured as above. The operation of the cleaning solution applicator 80 is controlled by the control portion 11 that controls the whole of the inkjet recording device. The control portion 11 executes a predetermined control program to control the drive of the cleaning solution pump 90 and the cleaning solution valve 92, and controls the giving of the cleaning solution.

Figure 7:
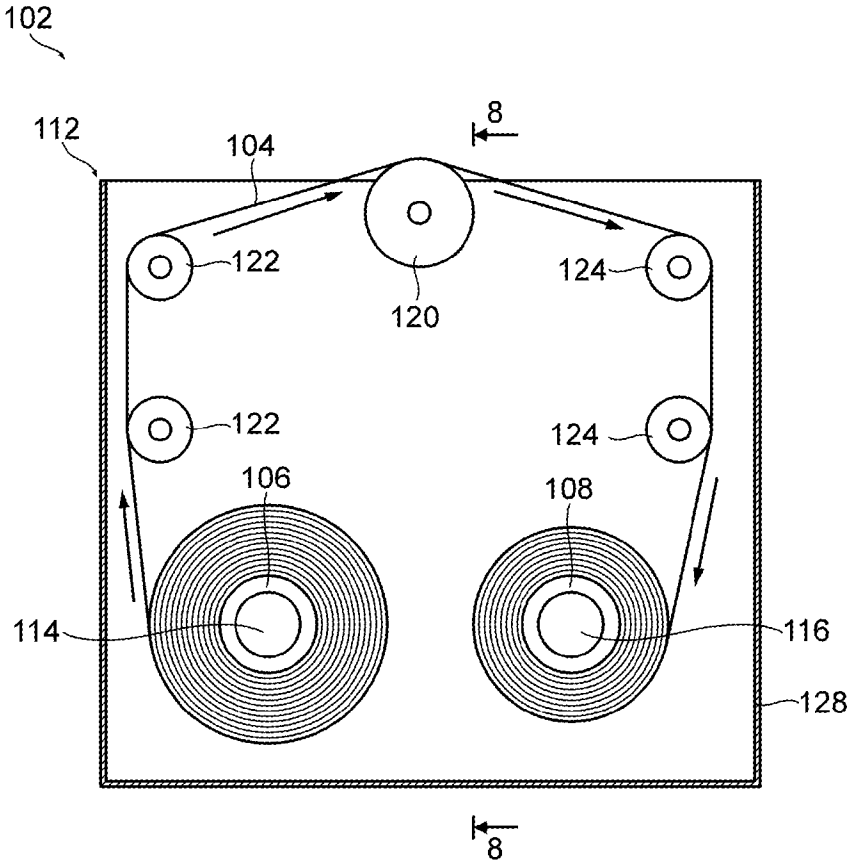
FIG. 7 is a front view illustrating a schematic structure of a wiping device.
Figure 8:
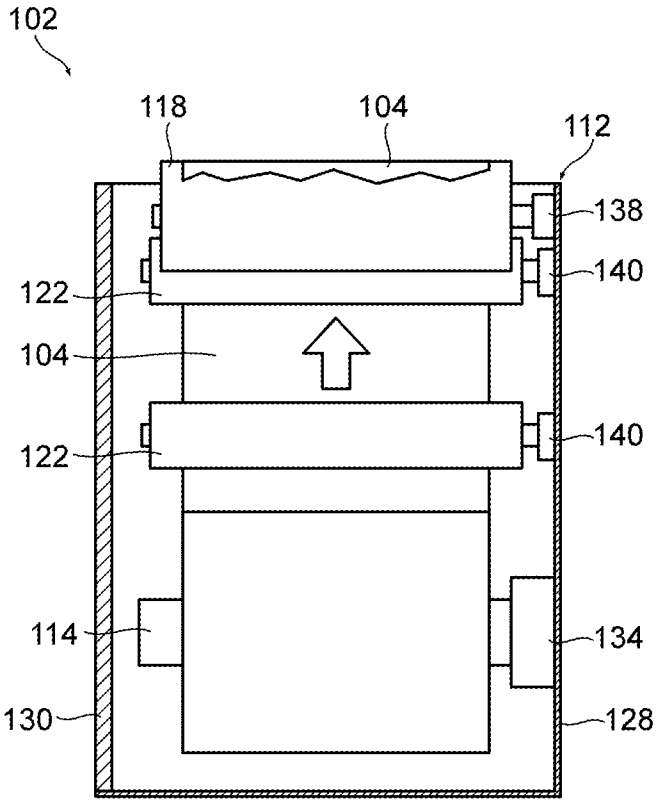
FIG. 8 is a cross-sectional view of 8-8 in FIG. 7.

FIG. 7 is a front view illustrating a schematic structure of the wiping device and FIG. 8 is a cross-sectional view of 8-8 in FIG. 7.

The wiping device 100 includes a wiping unit 102 that individually wipes off the nozzle surface 33 of the head 32 (32C, 32M, 32Y and 32K) mounted on the head support frame 34.

Each wiping unit 102 wipes off the nozzle surface 33 by running a wiping web 104 formed in a band shape while making it touch the nozzle surface 33 of the head 32. Each wiping unit 102 is detachably installed in a body frame (not illustrated) of a wiping device and arranged between the cleaning solution applicator 80 and the paper feed mechanism 20. That is, it is arranged so as to wipe off the nozzle surface 33 to which the cleaning solution is given by the cleaning solution applicator 80.

As illustrated in FIGS. 7 and 8, each wiping unit 102 includes a case 112, a reeling shaft 114 that reels the wiping web 104, a winding shaft 116 that winds the wiping web 104, a winding motor 118 that rotates and drives the winding shaft 116, a pair of reeling guides 122, 122 that performs guiding such that the wiping web 104 reeled from the reeling shaft 114 is wound on a pressure roller 120, and a pair of winding guides 124, 124 that performs guiding such that the wiping web 104 wound on the pressure roller 120 is wound by the winding shaft 116.

The wiping web 104 is formed with a sheet knitted or weaved using ultrafine fibers such as polyethylene terephthalate (PET), polyethylene (PE) and nylon (NY), for example, and formed in a band shape having a width corresponding to the width of the nozzle surface 33 of the head 32. This wiping web 104 is provided in a state where the wiping web 104 is wound in a roll shape by a reeling core 106 and the front edge thereof is fixed to a winding core 108.

The case 112 includes a case body 128 and a lid 130. The case body 128 is formed in a square box shape, in which an upper surface portion and an anterior surface portion are opened.

The lid 130 is attached to the anterior surface portion of the case body 128 through a hinge (not illustrated) so as to be able to open and close.

The reeling shaft 114 is fixed to a shaft support portion 134 in which one end of a shaft portion thereof is installed in the case body 128, and is horizontally installed in the case body 128. This reeling shaft 114 has a double pipe structure and is supported such that an outer cylinder can rotate around an inner cylinder. A negative rotation preventing mechanism and a friction mechanism are arranged between the inner cylinder and the outer cylinder, and the outer cylinder is formed so as to have constant resistance to rotate in only one direction (the reeling direction of the wiping web 104).

The reeling core 106 of the wiping web 104 is fixed to and mounted on this reeling shaft 114.

The winding shaft 116 is supported in a rotatable manner by a shaft support portion 136 in which one end of a shaft portion thereof is installed in the case body 128, and is horizontally installed in the case body 128. This winding shaft 116 has a double structure and is supported such that an outer cylinder can rotate around an inner cylinder. A torque limiter is arranged between the inner cylinder and the outer cylinder, and configured such that, when a load (torque) equal to or greater than a certain level is applied, the outer cylinder slips with respect to the inner cylinder.

The winding core 108 of the wiping web 104 is fitted to and mounted on this winding shaft 116.

The winding motor 118 is arranged in the back of the case body 128. This winding motor 118 is arranged on the same axis as the winding shaft 116 and coupled with the winding shaft 116. The winding shaft 116 is driven by this winding motor 118 and rotates to one direction (the winding direction of the wiping web 104). In this case, as described above, the winding shaft 116 slips when a load equal to or greater than a certain level is applied. As a result of this, it is possible to prevent excessive tension from being applied to the wiping web 104.

The pressure roller 120 is horizontally installed in the case body 128, in which one end of the shaft portion is supported in a rotatable manner by a shaft support portion 138 installed in the case body 128. The pressure roller 120 is formed with a rubber roller corresponding to the width of the wiping web 104, and a part of it is arranged so as to project from an upper opening of the case body 128.

The pair of reeling guides 122, 122 is horizontally installed in the case body 128, in which one end of each shaft portion thereof is supported in a rotatable manner by shaft support portions 140, 140 installed in the case body 128. This pair of reeling guides 122, 122 is arranged in parallel with a certain interval in the vertical direction and guides the wiping web 104 reeled from the reeling shaft 114 to the pressure roller 120.

The pair of winding guides 124, 124 is horizontally installed in the case body 128, in which one end of each shaft portion thereof is supported in a rotatable manner by shaft support portions 142, 142 installed in the case body 128. This pair of winding guides 124, 124 is arranged in parallel with a certain interval in the vertical direction and guides the wiping web 104 reeled from the pressure roller 120 to the winding shaft 116.

The reeling guides 122 and the winding guides 124 are bilaterally symmetrically arranged with respect to the pressure roller 120, and the reeling shaft 114 and the winding shaft 116 are bilaterally symmetrically arranged with respect to the pressure roller 120.

The wiping unit 102 configured as above mounts the wiping web 104, and, when the winding motor 118 is driven, the wiping web 104 is reeled from the reeling shaft 114 and wound by the winding shaft 116. As a result of this, the wiping web 104 runs. At this time, since the winding shaft 116 slips when a certain load is applied by the torque limiter while friction is applied to the reeling shaft 114 by a friction mechanism, it is possible to apply certain tension to the wiping web 104 and make the wiping web 104 run.

Also, as described above, since the wiping web 104 is provided while being wound in a roll shape by the reeling core 106, mounting (exchange) to the wiping unit 102 is performed in this state. To be more specific, after the reeling core 106 is fitted to and mounted on the reeling shaft 114, the reeling core 106 is wounded by the reeling guide 122, the pressure roller 120 and the winding guide 124 in order, and the winding core 108 is fitted to the winding shaft 116 to complete the mounting.

Each wiping unit 102 is detachably installed in a body frame of the wiping unit (not illustrated). The body frame of the wiping unit is installed in the main body frame (not illustrated) of the inkjet recording device, driven by the up-and-down mechanism which is not illustrated, and is installed so as to be able to rise and fall.

That is, when each wiping unit 102 is installed in the body frame of the wiping unit, each pressure roller 120 is arranged so as to be orthogonal to the longitudinal direction of the head 32 (that is, arranged so as to be orthogonal to the movement direction of the head 32). Therefore, when the winding motor 118 is driven, the wiping web 104 runs along the longitudinal direction of the head 32 (that is, runs in parallel to the movement direction of the head 32).

Moreover, when the wiping unit body frame is driven by the up-and-down mechanism (not illustrated) to rise and fall, each wiping unit 102 moves up and down between a predetermined wiping position and a standby position.

Here, the wiping position is set to a position in which the wiping web 104 wound by the pressure roller 120 contacts the nozzle surface 33 of the head 32 that moves from the moisturizing position to the image recording position. Moreover, the standby position is set to a position in which the wiping web 104 wound by the pressure roller 120 separates from the nozzle surface 33 of the head 32.

Therefore, if the wiping unit 102 is moved to the wiping position, it is possible to wipe off the nozzle surface 33 of the head 32 that moves from the moisturizing position to the image recording position, and, if it is moved to the standby position, it is possible to stop the wiping.

Here, the wiping unit 102 normally stands by in the standby position, and, only at the time of wiping, moves to the wiping position to wipe off the nozzle surface 33.

The wiping device 100 is configured as above. The operation of the wiping device 100 is controlled by the control portion 11 that controls the whole of the inkjet recording device. The control portion 11 executes a predetermined control program to control the drive of the wiping unit 102 and the up-and-down mechanism or the like, and performs wiping processing by the wiping device 100.

[Image Recording Method by Inkjet Recording Device]

Next, an image recording method by the inkjet recording device 10 of the present embodiment is roughly explained.

First, the head 32 is moved to the image recording position as preparation before the image recording processing is performed. As a result of this, each head 32 is set above the paper feed mechanism 20 such that it is possible to record an image in a paper P fed by the paper feed mechanism 20.

The paper P is supplied to the paper feed mechanism 20 by a paper supply mechanism (not illustrated). Predetermined pretreatment (for example, application of treatment liquid having a function to aggregate ink, etc.) is optionally applied to the paper P.

The paper feed mechanism 20 receives the paper P supplied by the paper supply mechanism and performs feeding along a feed path.

Each head 32 ejects an ink drop toward the paper P fed by the paper feed mechanism 20 and records an image on the surface (upper surface) of the paper P.

The paper P in which the image is recorded is collected by a collection mechanism (not illustrated). Treatment such as drying and fixing is optionally performed on the paper P.

By continuously feeding the paper P, continuous image recording processing is performed.

[Cleaning Method of Nozzle Surface of Head]

Next, a method of cleaning the nozzle surface 33 of the head 32 is described.

As described above, in the inkjet recording device of the present embodiment, the nozzle surface 33 of the head 32 is cleaned while the head 32 moves from the moisturizing position to the image recording position. That is, the nozzle surface 33 is cleaned using the movement of the head 32.

First, the control portion 11 moves the wiping unit 102 located in the standby position to the wiping position. As a result of this, each wiping unit 102 is located in a predetermined wiping position.

Next, the control portion 11 causes the head 32 located in the moisturizing position to move toward the image recording position at a constant speed.

Next, the control portion 11 opens the cleaning solution valve 92 according to the timing a front edge of the head 32 (here, an edge on the image recording positional side) arrives at the cleaning solution nozzle 84, and the control portion 11 drives the cleaning solution pump 90. As a result of this, the cleaning solution is jetted from the cleaning solution nozzle 84. Subsequently, when the head 32 passes on the cleaning solution nozzle 84 from which this cleaning solution is jetted, the cleaning solution is given to the nozzle surface 33.

Moreover, the control portion 11 drives the winding motor 118 according to the timing the front edge of the head 32 arrives at the wiping unit 102. As a result of this, the wiping web 104 is wound by the winding shaft 116 and runs at a constant speed. At this time, the wiping web 104 runs in the opposite direction (counter direction) to the movement direction of the head 32. When the head 32 passes on this wiping unit 102, the nozzle surface 33 contacts with the wiping web 104 and the nozzle surface 33 is wiped off by the wiping web 104.

The control portion 11 stops the drive of the cleaning solution pump 90 according to the timing a rear edge of the head 32 (here, an edge on the moisturizing positional side) passes the cleaning solution nozzle 84, and the control portion 11 closes the cleaning solution valve 92. As a result of this, a jet of the cleaning solution is stopped.

Moreover, the control portion 11 stops the drive of the winding motor 118 according to the timing the rear edge of the head 32 passes the wiping unit 102. As a result of this, the running of the wiping web 104 stops.

After that, the control portion 11 drives the up-and-down mechanism of the wiping unit 102 and moves the wiping unit 102 to the standby position.

The cleaning of the nozzle surface 33 is completed by the above-mentioned series of steps. Thus, the cleaning of the nozzle surface 33 is performed in process in which the head 32 moves from the moisturizing position to the image recording position.

The cleaning of the nozzle surface 33 is periodically performed. For example, it is performed every time the number of papers printed by the inkjet recording device reaches a predetermined number. Moreover, for example, it is performed at the time of the operation start or operation stop of the inkjet recording device. Moreover, it is optionally performed according to an instruction from an operator.

[Recovery Processing of Liquid-Repellent Performance on Nozzle Surface]

As described above, the liquid-repellent film 36 is formed on the nozzle surface 33 of the head 32. By this liquid-repellent film 36, dirt is less likely to adhere to the nozzle surface 33 of the head 32.

However, as described above, when the nozzle surface 33 of the head 32 is cleaned, the liquid-repellent performance gradually degrades in this liquid-repellent film 36.

Therefore, recovery processing of the liquid-repellent performance on the surface of the liquid-repellent film 36 is performed before certain liquid-repellent performance is not provided.

The recovery processing of the liquid-repellent performance on the surface of the liquid-repellent film 36 is performed by the liquid-repellent performance recovery processing unit 60 by heating the nozzle surface 33 of each head 32 (to be more specific, the liquid-repellent film 36 formed on the nozzle surface 33) by the heater 62. The recovery processing of the liquid-repellent performance on the surface of this liquid-repellent film 36 is performed after the nozzle surface 33 is cleaned.

As described above, the cleaning of the nozzle surface 33 is performed while the head 32 moves from the moisturizing position to the image recording position. In a case where the recovery processing of the liquid-repellent performance on the surface of the liquid-repellent film 36 is performed, it is performed when the head 32 is moved from the image recording position to the recovery processing position after the head 32 is moved from the moisturizing position to the image recording position and cleaned.

When the head 32 moves to the recovery processing position, the heater 62 is driven and the heating surface 64 of the heater 62 is heated to a predetermined temperature. Subsequently, when the temperature on the heating surface 64 of the heater 62 becomes stable, an up-and-down mechanism (not illustrated) that moves up and down the heater 62 is driven and the heating surface 64 of the heater 62 contacts with the nozzle surface 33 of each head 32. As a result of this, the nozzle surface 33 is heated. The heating of the nozzle surface 33 is carried on for a certain period of time, and, when a certain period of time elapses after the heating surface 64 of the heater 62 contacted with the nozzle surface 33, the up-and-down mechanism (not illustrated) that moves up and down the heater 62 is driven and the heater 62 is separated from the nozzle surface 33.

Thus, by heating the nozzle surface 33, it is possible to recover the liquid-repellent performance on the surface of the liquid-repellent film 36 formed on the nozzle surface 33. This mechanism is as follows.

As described above, the liquid-repellent film 36 is formed with an amorphous fluorine resin material on the nozzle surface 33 of the head 32 in the inkjet recording device of the present embodiment.

When the liquid-repellent film 36 formed with the amorphous fluorine resin material is heated, a fluorine substrate in the liquid-repellent film 36 moves to the surface of the liquid-repellent film 36 (because, when the fluorine substrate is heated, it moves to the surface by the driving force). As a result of this, the liquid-repellent performance on the surface of the liquid-repellent film 36 recovers.

Thus, by heating the liquid-repellent film 36 formed with the amorphous fluorine resin, it is possible to recover the liquid-repellent performance on the surface.

However, since the liquid-repellent film 36 is resin, there is a problem that, when it is excessively heated, a pattern formed in the liquid-repellent film 36 collapses. Especially, there is a problem that the pattern of the liquid-repellent film 36 collapses due to softening of the amorphous fluorine resin when the liquid-repellent film 36 is heated more than the melting point of the amorphous fluorine resin that forms the liquid-repellent film 36. Moreover, there occurs a problem that the liquid-repellent film 36 melts and enters the inside of the nozzle, and there occurs a problem that the opening of the nozzle is transformed from an anisotropic shape into a taper shape and an ejection defect is caused.

Therefore, it is desirable that the heating temperature at the time of heating the liquid-repellent film 36 is equal to or less than the melting point of the amorphous fluorine resin that forms the liquid-repellent film 36. In a case where the liquid-repellent film 36 is formed with CYTOP (registered trademark), since the melting point of CYTOP (registered trademark) is 108 degrees Celsius, it is preferable to heat the liquid-repellent film 36 at 108 degrees Celsius or less.

On the other hand, since it is not possible to recover the liquid-repellent performance on the surface of the liquid-repellent film 36 when the heating temperature of the liquid-repellent film 36 is excessively low, the liquid-repellent film 36 is heated at a temperature at which it is possible to recover the liquid-repellent performance on the surface of the liquid-repellent film 36, or more. This temperature can be calculated by conducting experiments, and so on.

For example, in a case where the liquid-repellent film 36 is formed with CYTOP (registered trademark), it is preferable to set the heating temperature of the liquid-repellent film 36 to a temperature between 90 degrees Celsius and the melting point (108 degrees Celsius), inclusive, for example, about 100 degrees Celsius.

Similarly, since there occurs a problem that a pattern formed in the liquid-repellent film 36 collapses or the like if the heating time is excessively long when the liquid-repellent film 36 is heated, it is preferable to set the heating time of the liquid-repellent film 36 within a range in which these problems do not occur. For example, in a case where the liquid-repellent film 36 is formed with CYTOP (registered trademark) and the heating temperature of the liquid-repellent film 36 is assumed to be 100 degrees Celsius, the heating time of the liquid-repellent film 36 can be set to 60 seconds. As a result of this, it is possible to recover the liquid-repellent performance on the surface of the liquid-repellent film 36 while suppressing the transformation of the pattern formed in the liquid-repellent film 36.

As described above, although the liquid-repellent performance recovery processing of the liquid-repellent film 36 is performed after the cleaning of the nozzle surface 33 is implemented, it does not have to be necessarily performed every time the nozzle surface 33 is cleaned, and it is preferable to implement it before certain liquid-repellent performance is not provided. For example, when the number of times the nozzle surface 33 is cleaned is counted by a cleaning number count portion 71 and the cleaning number reaches a predetermined threshold (recovery processing execution number threshold), the liquid-repellent performance recovery processing of the liquid-repellent film 36 may be forcibly performed and the counted cleaning number may be reset. It is preferable to set a threshold (recovery processing execution number threshold) of the cleaning number to execute the liquid-repellent performance recovery processing of this liquid-repellent film 36, to a number (for example, 500 times) at which it is possible to perform the recovery processing before certain liquid-repellent performance on the surface of the liquid-repellent film 36 is not provided, and it is preferable to calculate it in advance by experiments, and so on.

Moreover, in a case where the liquid-repellent performance on the surface of the liquid-repellent film 36 is actually inspected and the liquid-repellent performance is equal to or less than a certain level, the liquid-repellent performance recovery processing may be performed. For example, the liquid-repellent performance on the surface of the liquid-repellent film 36 can be checked by measuring the liquid contact angle with respect to the surface of the liquid-repellent film 36. Therefore, for example, the liquid contact angle with respect to the surface of the liquid-repellent film 36 is measured by a contact angle measurement portion 61, and in a case where the measured contact angle is equal to or less than a predetermined threshold (recovery processing execution contact angle threshold), the liquid-repellent performance recovery processing of the liquid-repellent film 36 may be performed. It is preferable to set a threshold for the liquid contact angle with respect to the surface of the liquid-repellent film 36 (recovery processing execution contact angle threshold), which is provided to perform the liquid-repellent performance recovery processing of this liquid-repellent film 36, to a contact angle (for example, 60 degrees) at which it is possible to perform the recovery processing before certain liquid-repellent performance on the surface of the liquid-repellent film 36 is not provided, and it is preferable to calculate it in advance by experiments, and so on.

The liquid used to measure the contact angle by the contact angle measurement portion 61 may be a liquid of the same type as a liquid (for example, ink) ejected from nozzle N of the head 32. For example, the surface tension of the liquid (for example, ink) used to measure the contact angle is between 25 mN/m and 50 mN/m, inclusive, for example, 30 mN/m.

The inspection of the liquid-repellent performance on the surface of the liquid-repellent film 36 (for example, measurement of the contact angle of the liquid with respect to the surface of the liquid-repellent film 36) is implemented, for example, every time the nozzle surface 33 is cleaned predetermined times, and, in a case where it is determined that the liquid-repellent performance on the surface of the liquid-repellent film 36 is equal to or less than a certain level, the liquid-repellent performance recovery processing is performed. Therefore, for example, in a case where the liquid-repellent performance on the surface of the liquid-repellent film 36 is inspected by measuring the liquid contact angle with respect to the surface of the liquid-repellent film 36 in the contact angle measurement portion 61, the number of times the nozzle surface 33 is cleaned is counted by the cleaning number count portion 71, and, when the cleaning number reaches a predetermined threshold (contact angle measurement execution number threshold), the liquid contact angle with respect to the surface of the liquid-repellent film 36 is measured by the contact angle measurement portion 61 (and the counted cleaning number is reset). Further, only in a case where the measured contact angle is equal to or less than a threshold (recovery processing execution contact angle threshold), the liquid-repellent performance recovery processing of the liquid-repellent film 36 is performed.

The timing of measuring the liquid contact angle with respect to the surface of the liquid-repellent film 36, that is, a threshold for the cleaning number to measure the liquid contact angle with respect to the surface of the liquid-repellent film 36 (contact angle measurement execution number threshold) is set to a number at which it is possible to adequately understand the liquid-repellent performance on the surface of the liquid-repellent film 36, obtained by experiments or the like and set to an appropriate value. For example, the measurement of the contact angle is performed every time the nozzle surface 33 is cleaned 100 times.

In the above-mentioned embodiment, although an example has been explained where a mechanism that inspects the liquid-repellent performance on the surface of the liquid-repellent film 36 (for example, the contact angle measurement portion 61) is mounted on the inkjet recording device 10, it is possible to adopt a configuration in which the mechanism that inspects the liquid-repellent performance on the surface of the liquid-repellent film 36 is prepared outside of the inkjet recording device.

Moreover, in the above-mentioned embodiment, although an example has been explained where the liquid-repellent performance recovery processing unit 60 is mounted on the inkjet recording device 10, it is possible to adopt a configuration in which the mechanism (mechanism that heats the nozzle surface 33 of the head 32) to recover the liquid-repellent performance on the surface of the liquid-repellent film 36 is prepared outside of the inkjet recording device. That is, processing of heating the nozzle surface 33 can be performed outside of the inkjet recording device. In this case, the head 32 is detached from the head support frame 34 once and the nozzle surface 33 is heated outside of the inkjet recording device.

Moreover, in the above-mentioned embodiment, although a rubber heater is used as a component that heats the nozzle surface 33 of the head 32, the heater composition is not limited to this. Besides this, it is possible to form it using a ribbon heater. Moreover, although a configuration is adopted in which the nozzle surface 33 is heated by contacting the heating surface of the heater to the nozzle surface 33 of the head 32, for example, it is possible to adopt a configuration in which the nozzle surface 33 is heated by radiation using an infrared heater.

In addition, in the above-mentioned embodiment, although a configuration is adopted in which the whole surface of the nozzle surface of the head 32 formed in an elongated shape is heated at a time, a configuration is also possible in which the nozzle surface of the head 32 is divided into several regions and the heating is performed in each region. Moreover, for example, a configuration is also possible in which a heat source and the head 32 are relatively moved and the nozzle surface 33 of the head 32 is heated.

Also, such as the above-mentioned embodiment, it is possible to uniformly heat the whole surface of the nozzle surface 33 by heating the whole surface of the nozzle surface 33 at a time and prevent heating non-uniformity or the like from being caused.

Moreover, in the above-mentioned embodiment, although a configuration is adopted in which the nozzle surface 33 is wiped off by the wiping web 104, a component to wipe off the nozzle surface 33 is not limited to this. For example, it is possible to adopt a configuration in which the nozzle surface 33 is wiped off by a blade.

Moreover, in the above-mentioned embodiment, although a configuration is adopted in which the cleaning solution is applied to the nozzle surface 33 by the cleaning solution applicator 80, a configuration is also possible in which the cleaning solution is applied to the nozzle surface 33 by a cap. In addition, a configuration is also possible in which ink is overflowed from nozzle N and the nozzle surface is wet by the ink.

Moreover, in the above-mentioned embodiment, although the liquid-repellent performance recovery processing unit 60 is installed near the moisturizing unit 50, the layout of the maintenance mechanism 40 is not limited to this and it is possible to adequately change the layout in consideration of the device space or the like.

Moreover, in the present embodiment, although the liquid-repellent performance recovery processing unit 60 is fixed and installed, it is possible to adopt a configuration such that the liquid-repellent performance recovery processing unit 60 can move. That is, it is possible to adopt a configuration in which the heater is moved toward a head placed in a fixed position and the nozzle surface is heated.

[Production Method of Head]

FIGS. 9A to 9F, 10A and 10B are process drawings illustrating one example of a production process of the inkjet head of the present embodiment.

Figure 9A:
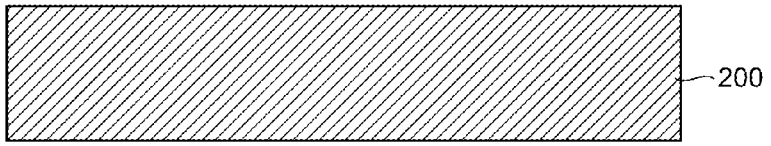
FIG. 9A is a process drawing illustrating a production process of the inkjet head according to the present embodiment.

A nozzle plate 200 forming the nozzle surface of the head is formed with a silicon substrate (FIG. 9A). As the silicon substrate, for example, it is possible to use a silicon substrate and SOI substrate of both-surface polishing.

Figure 9B:
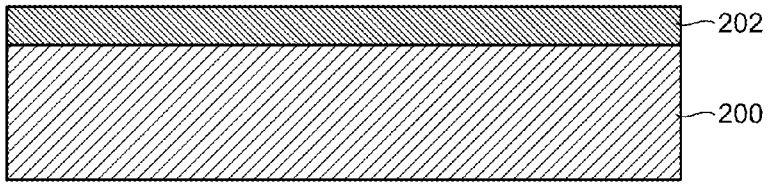
FIG. 9B is a process drawing illustrating a production process of the inkjet head according to the present embodiment.

First, a liquid-repellent film 202 having a predetermined film thickness is formed on the surface of this nozzle plate 200 (surface in which the nozzle surface is formed) by the use of an amorphous fluorine resin material (FIG. 9B). The liquid-repellent film 202 can be formed by, for example, forming a material liquid film on the surface of the nozzle plate 200 by a spin coat method and applying heat treatment to the material liquid film.

As an amorphous fluorine resin material, for example, it is possible to use CYTOP (registered trademark) made by Asahi Glass Co., Ltd. and Teflon AF (Teflon is a registered trademark) made by Du Pont-Mitsui Fluorochemicals Company, Ltd.

The liquid-repellent film 202 can be coated using a dip method, a deposition method and a CVD method other than the spin coat method. The film thickness of the liquid-repellent film 202 may be about 0.2 μm to 5 μm, for example.

In the present embodiment, the liquid-repellent film 202 is formed by using CYTOP (registered trademark) as an amorphous fluorine resin material, forming a material liquid film having a thickness of about 3 μm on the surface of the nozzle plate 200 by the spin coat method, applying heat treatment using an oven to the film at about 50 degrees Celsius for one hour and subsequently at about 200 degrees Celsius for one hour.

Figure 9C:
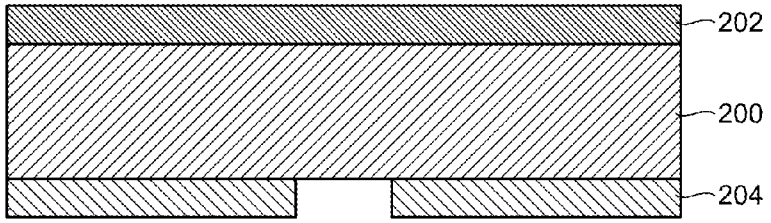
FIG. 9C is a process drawing illustrating a production process of the inkjet head according to the present embodiment.

Thus, after the liquid-repellent film 202 is formed with the amorphous fluorine resin on the surface of the nozzle plate 200, a mask pattern 204 corresponding to the opening of the nozzle is formed on the back surface of the nozzle plate 200 by a photoresist (FIG. 9C).

Figure 9D:
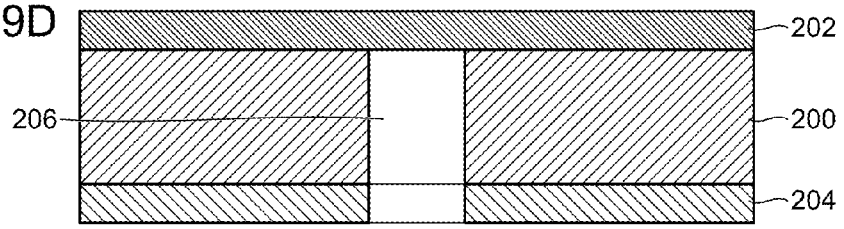
FIG. 9D is a process drawing illustrating a production process of the inkjet head according to the present embodiment.

Next, silicon is etched from the back surface side of the nozzle plate 200 to form a channel 206 of the nozzle (FIG. 9D). For example, the silicon can be etched by the dry etching method or the wet etching method. In the present embodiment, the channel 206 of the nozzle is formed by etching the silicon by the dry etching method.

Figure 9E:
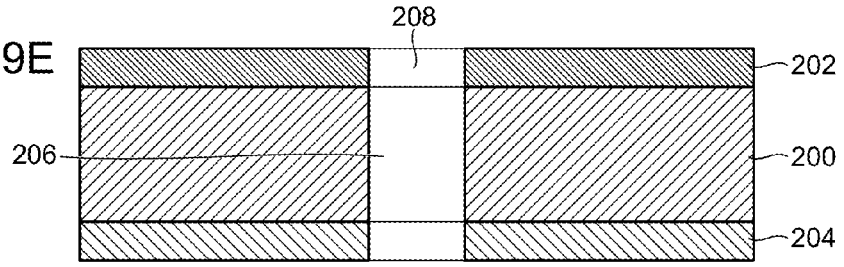
FIG. 9E is a process drawing illustrating a production process of the inkjet head according to the present embodiment.

Next, an opening 208 of the nozzle is formed in the liquid-repellent film 202 (FIG. 9E). For example, the opening 208 can be formed by the dry etching method. In the present embodiment, the opening 208 is formed by etching the liquid-repellent film 202 by oxygen plasma.

Figure 9F:
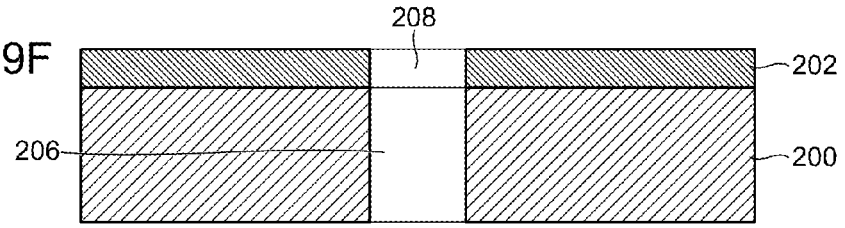
FIG. 9F is a process drawing illustrating a production process of the inkjet head according to the present embodiment.

Next, the mask pattern 204 is removed from the nozzle plate 200 by ashing or dedicated peel solution (FIG. 9F).

The nozzle plate in which the liquid-repellent film is formed on the nozzle surface by the above-mentioned series of processes is produced.

Figure 10A:
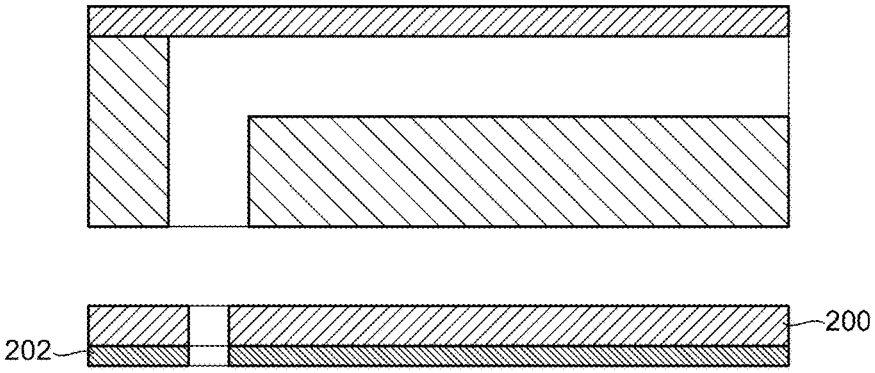
FIG. 10A is a process drawing illustrating a production process of the inkjet head according to the present embodiment.
Figure 10B:
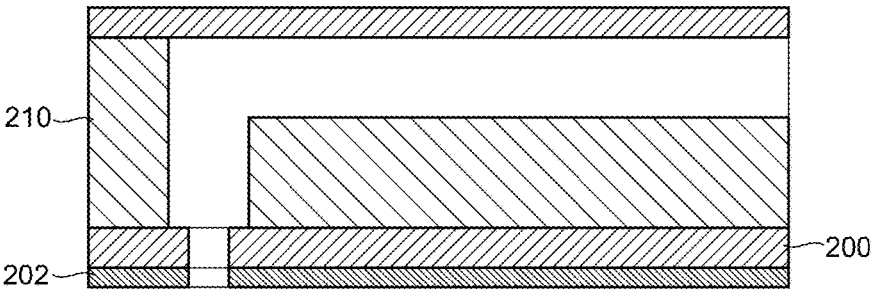
FIG. 10B is a process drawing illustrating a production process of the inkjet head according to the present embodiment.

Next, as illustrated in FIGS. 10A and 10B, the nozzle plate 200 is joined to a substrate 210 in which a pressure chamber, a channel and a piezoelectric element are formed. This joining can be performed by, for example, joining by an adhesive, normal temperature joining of silicon or eutectic joining of silicon.

By the above-mentioned series of processes, an inkjet head is produced in which the liquid-repellent film is formed with the amorphous fluorine resin material on the nozzle surface.

EXAMPLES

First Example

First, an experiment was conducted to confirm the recovery of the liquid-repellent performance on the surface of the liquid-repellent film by heating.

The experiment was conducted by forming a liquid-repellent film on a silicon substrate using CYTOP (registered trademark) that is an amorphous fluorine resin, measuring the contact angle of ink (surface tension is 30 mN/m) with respect to an unused liquid-repellent film surface, measuring the contact angle of ink with respect to the liquid-repellent film surface after cleaning is performed 1000 times, and measuring the contact angle of ink with respect to the liquid-repellent film surface after the liquid-repellent performance recovery processing is performed on the liquid-repellent film that has been cleaned 1000 times. The liquid-repellent performance recovery processing was performed several times while changing the heating temperature to 80 degrees Celsius, 90 degrees Celsius, 100 degrees Celsius, 120 degrees Celsius and 180 degrees Celsius.

Figure 11:
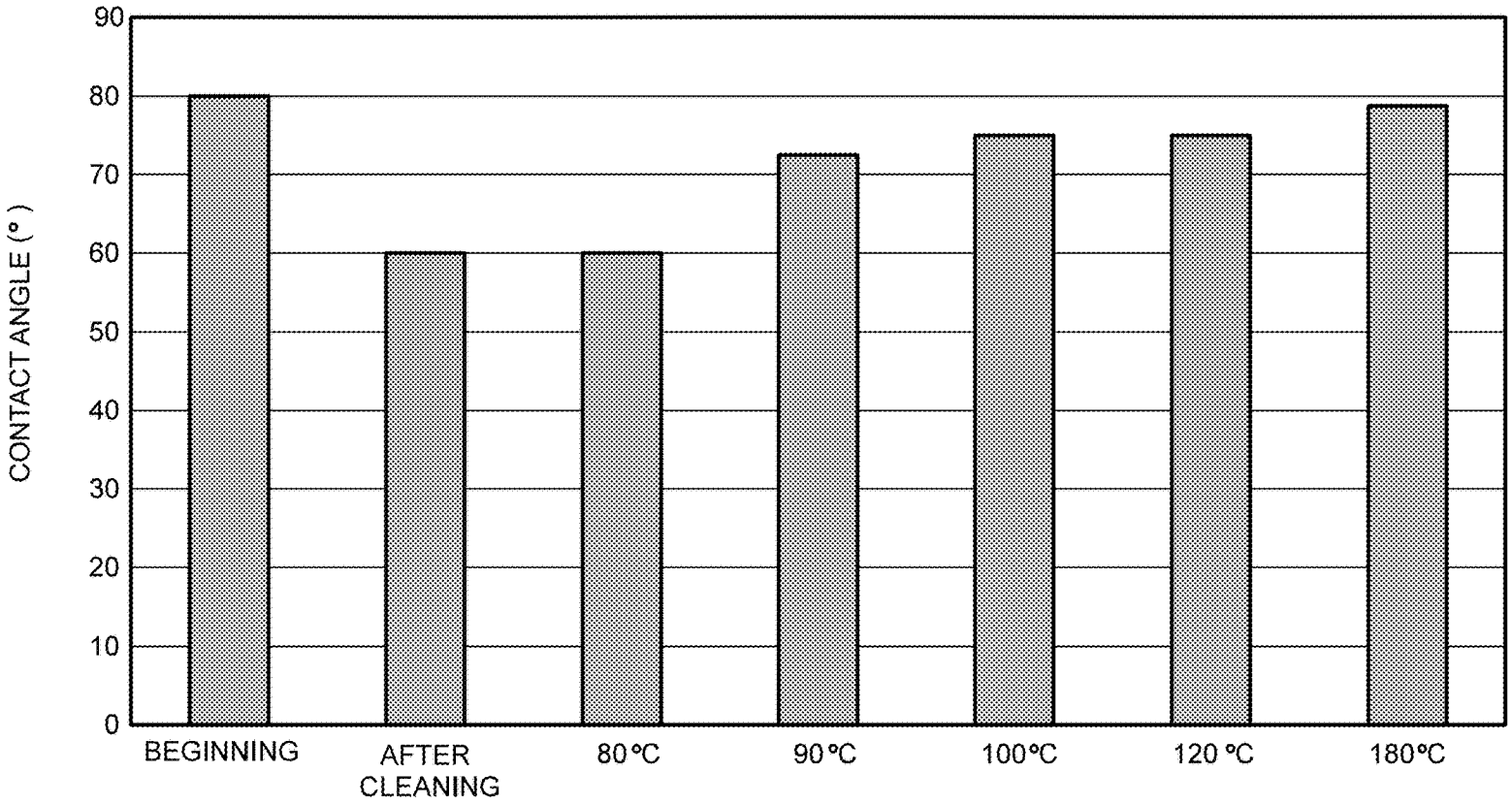
FIG. 11 is a graph illustrating the relationship between a heating temperature and a recovery result of liquid-repellent performance.

FIG. 11 is a graph illustrating the experimental result. As illustrated in FIG. 11, the contact angle of ink with respect to an unused liquid-repellent film surface is 80 degrees and the contact angle of ink with respect to the liquid-repellent film surface after being cleaned 1000 times decreased to 60 degrees. When the liquid-repellent performance recovery processing is implemented while changing the heating temperature (80 degrees Celsius, 90 degrees Celsius, 100 degrees Celsius, 120 degrees Celsius and 180 degrees Celsius) with respect to the liquid-repellent film after being cleaned 1000 times, it is confirmed that the liquid-repellent performance recovers (the contact angle recovers) by heating it at a temperature of 90 degrees Celsius or more.

Second Example

Next, an experiment was conducted to confirm the transformation condition of the liquid-repellent film by heating.

The experiment was conducted by forming a grid pattern film on the silicon substrate using CYTOP (registered trademark) that is an amorphous fluorine resin, and confirming the transformation of the pattern when the film is heated while changing the temperature.

The heating temperature is assumed to be 100 degrees Celsius, 120 degrees Celsius and 180 degrees Celsius, and the heating time is assumed to be 60 seconds.

Figure 12:
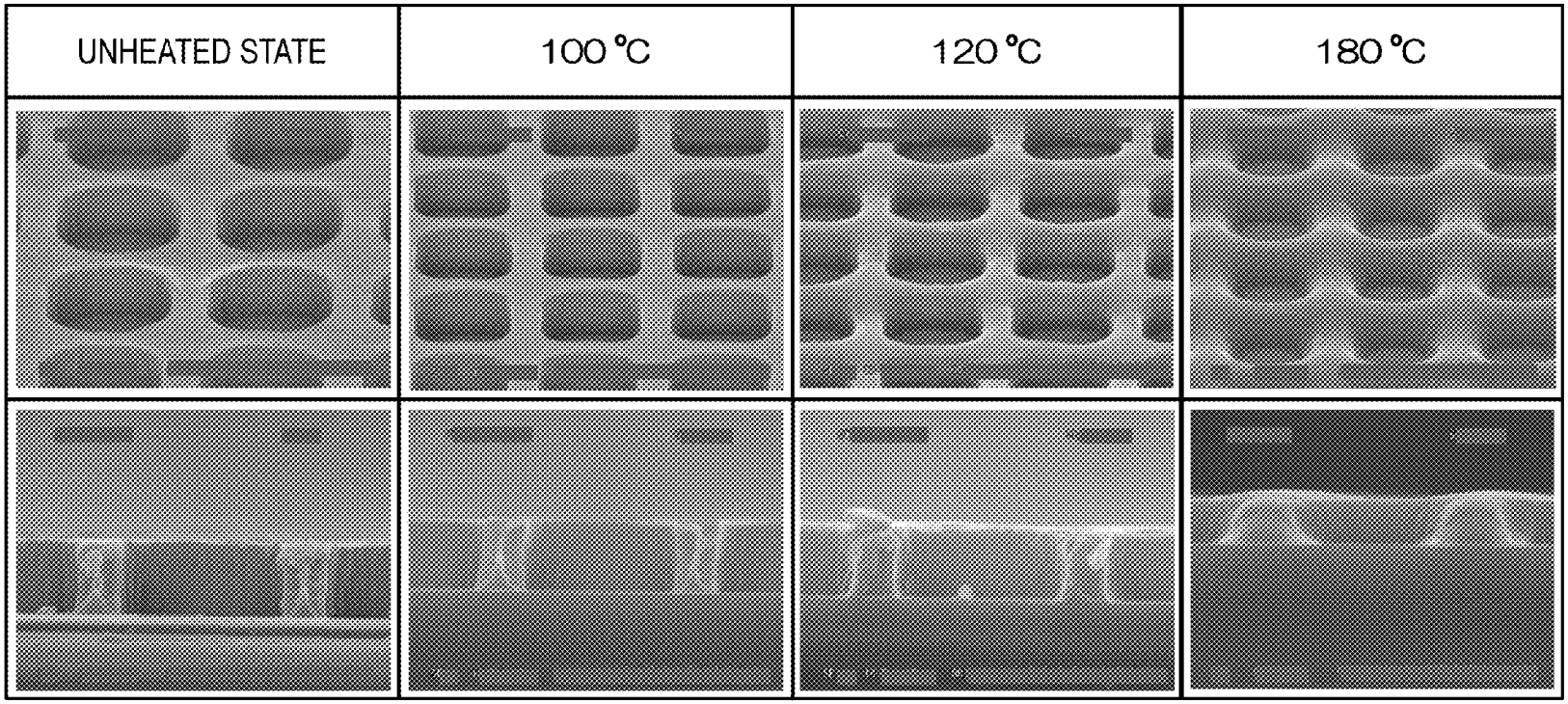
FIG. 12 illustrates a scanning electron microscope image illustrating a deformation state of a film formation pattern in each heating temperature.

FIG. 12 illustrates an image of an unheated film observed by a scanning electron microscope (SEM) and a SEM image of the film after being heated at each temperature, where the upper part illustrates SEM images of the film surface and the lower part illustrates SEM images of the film cross-sectional surface.

As illustrated in FIG. 12, although the film cross-sectional surface is anisotropic (rectangle) in the unheated film, the corner is slightly rounded off and curls in an example where the film is heated to 108 degrees Celsius or more (120 degrees Celsius) that is the melting point of CYTOP (registered trademark). Moreover, in an example where the film is heated to 180 degrees Celsius, the film completely melts and the corner is rounded off.

In view of the above, it is found that the temperature to heat a liquid-repellent film in the liquid-repellent performance recovery processing is desirable to be equal to or less than the melting point of an amorphous fluorine resin forming a liquid-repellent film.

Moreover, by the above-mentioned first example and second example, it is found that it is the most preferable to set the temperature to heat the liquid-repellent film in the liquid-repellent performance recovery processing to around 100 degrees.

What is claimed is:

1. An inkjet recording device comprising:

an inkjet head that has a nozzle surface in which a nozzle opening of a nozzle to eject a liquid is formed and on which a liquid-repellent film is formed with an amorphous fluorine resin material;

a cleaning portion configured to wipe off and clean a surface of the liquid-repellent film by a wiping member;

a liquid-repellent performance recovery processing portion configured to perform liquid-repellent performance recovery processing to recover liquid-repellent performance on the surface of the liquid-repellent film by heating the liquid-repellent film; and a cleaning number count portion configured to count a number of times the cleaning portion cleans the surface of the liquid-repellent film, wherein the liquid-repellent performance recovery processing portion performs the liquid-repellent performance recovery processing only in a case where the number of times of cleaning counted by the cleaning number count portion reaches a recovery processing execution number threshold defined in advance.

2. The inkjet recording device according to claim 1, wherein the liquid-repellent performance recovery processing portion heats a whole surface of the liquid-repellent film in the liquid-repellent performance recovery processing at a time.

3. The inkjet recording device according to claim 1, wherein the liquid-repellent performance recovery processing portion heats the liquid-repellent film at a temperature between 90 degrees Celsius and a melting point of the amorphous fluorine resin material, inclusive, for a certain period of time, in the liquid-repellent performance recovery processing.

4. The inkjet recording device according to claim 3, wherein the liquid-repellent performance recovery processing portion heats the liquid-repellent film at about 100 degrees Celsius for the certain period of time in the liquid-repellent performance recovery processing.

5. A maintenance method of an inkjet recording device that records an image on a recording medium using an inkjet head that has a nozzle surface in which a nozzle opening of a nozzle to eject a liquid is formed and on which a liquid-repellent film is formed with an amorphous fluorine resin material, the method comprising:

a cleaning step of wiping off and cleaning a surface of the liquid-repellent film by a wiping member;

a liquid-repellent performance recovery processing step of recovering liquid-repellent performance on the surface of the liquid-repellent film by heating the liquid-repellent film; and a cleaning number count step of counting a number of times the cleaning step is executed, wherein the liquid-repellent performance recovery processing step is executed only in a case where the number of times of cleaning counted in the cleaning number count step reaches a recovery processing execution number threshold defined in advance.

6. A maintenance method of an inkjet recording device that records an image on a recording medium using an inkjet head that has a nozzle surface in which a nozzle opening of a nozzle to eject a liquid is formed and on which a liquid-repellent film is formed with an amorphous fluorine resin material, the method comprising:

a cleaning step of wiping off and cleaning a surface of the liquid-repellent film by a wiping member;

a liquid-repellent performance recovery processing step of recovering liquid-repellent performance on the surface of the liquid-repellent film by heating the liquid-repellent film;

a contact angle measurement step of measuring a contact angle of the liquid with respect to the surface of the liquid-repellent film; and a cleaning number count step of counting a number of times the cleaning step is executed, wherein:

the contact angle measurement step is executed only in a case where the number of times of cleaning counted in the cleaning number count step reaches a contact angle measurement execution number threshold defined in advance; and the liquid-repellent performance recovery processing step is executed only in a case where the contact angle measured in the contact angle measurement step is equal to or less than a recovery processing execution angle threshold defined in advance.

7. The method according to claim 6, wherein the recovery processing execution angle threshold is 60 degrees.

8. The method according to claim 5, wherein a whole surface of the liquid-repellent film is heated at a time in the liquid-repellent performance recovery processing step.

9. The method according to claim 5, wherein the liquid-repellent film is heated at a temperature between 90 degrees Celsius and a melting point of the amorphous fluorine resin material, inclusive, for a certain period of time, in the liquid-repellent performance recovery processing step.

10. The method according to claim 9, wherein the liquid-repellent film is heated at about 100 degrees Celsius for the certain period of time in the liquid-repellent performance recovery processing step.

11. The method according to claim 6, wherein the liquid-repellent film is heated at a temperature between 90 degrees Celsius and a melting point of the amorphous fluorine resin material, inclusive, for a certain period of time, in the liquid-repellent performance recovery processing step.

12. The method according to claim 11, wherein the recovery processing execution angle threshold is 60 degrees.

* * * * *